US011393443B2

(12) United States Patent
Kim et al.

(10) Patent No.: US 11,393,443 B2
(45) Date of Patent: Jul. 19, 2022

(54) APPARATUSES AND METHODS FOR CREATING NOISE ENVIRONMENT NOISY DATA AND ELIMINATING NOISE

(71) Applicant: AGENCY FOR DEFENSE DEVELOPMENT, Daejeon (KR)

(72) Inventors: Hong Kook Kim, Gwangju (KR); Jung Hyuk Lee, Gwangju (KR); Seung Ho Choi, Seoul (KR); Deokgyu Yun, Seoul (KR)

(73) Assignee: Agency for Defense Development, Daejeon (KR)

( * ) Notice: Subject to any disclaimer, the term of this patent is extended or adjusted under 35 U.S.C. 154(b) by 168 days.

(21) Appl. No.: 16/887,419

(22) Filed: May 29, 2020

(65) Prior Publication Data

US 2020/0380943 A1 Dec. 3, 2020

(30) Foreign Application Priority Data

May 30, 2019 (KR) ..... 10-2019-0064111

(51) Int. Cl.
*G10K 11/16* (2006.01)
*G10L 25/18* (2013.01)
*G10L 25/30* (2013.01)

(52) U.S. Cl.
CPC ..... *G10K 11/16* (2013.01); *G10L 25/18* (2013.01); *G10L 25/30* (2013.01)

(58) Field of Classification Search
CPC ..... G10K 11/16; G10L 25/18; G10L 25/30
See application file for complete search history.

(56) References Cited

U.S. PATENT DOCUMENTS

| | | | | |
|---|---|---|---|---|
| 10,283,140 | B1 * | 5/2019 | Yu | G10L 19/04 |
| 10,726,858 | B2 * | 7/2020 | Germain | G06N 5/046 |
| 11,100,941 | B2 * | 8/2021 | Sargsyan | G06F 17/16 |
| 2011/0191101 | A1 * | 8/2011 | Uhle | G10L 21/0208 704/205 |

OTHER PUBLICATIONS

Odelowo et al.; "A Study of Training Targets for Deep Neural Network-Based Speech Enhancement Using Noise Prediction"; ICASSP; Apr. 20, 2018 (Year: 2018).*
Zhao et al.; "A Study of Training Targets for Deep Neural Network-Based Speech Enhancement Using Noise Prediction"; ICASSP; Apr. 20, 2018 (Year: 2018).*

(Continued)

*Primary Examiner* — David L Ton
(74) *Attorney, Agent, or Firm* — Knobbe Martens Olson & Bear LLP

(57) ABSTRACT

A data generating apparatus for generating noise environment noisy data is disclosed. The data generating apparatus according to the present application comprises a signal conversion unit configured to convert each of a noisy signal obtained in real environment and an original sound signal for the noisy signal into a noisy signal spectrum and an original sound signal spectrum in a short-time frequency domain; and a noisy signal generation training unit configured to train deep neural network to output the noisy signal spectrum corresponding to each short-time using the original sound signal spectrum as an input.

7 Claims, 6 Drawing Sheets

(56) References Cited

OTHER PUBLICATIONS

Xu et al., "A Regression Approach to Speech Enhancement Based on Deep Neural Networks", IEEE/ACM Transactions on Audio, Speech, and Language Processing, vol. 23, No. 1—13 pages (Jan. 2015).
Wang et al., "Joint Noise and Mask Aware Training for DNN-based Speech Enhancement with Sub-band Features", (2017), IEEE Hands-free Speech Communications and Microphone Arrays (HSCMA)—5 pages (Mar. 1, 2017).
Yun et al., "Deep Learning-Based Virtual Database Creation Techniques for Denoising Model Training", the Journal of Korean Institute of Communications and Information Sciences '19-05, vol. 44, No. 5—4 pages (May 31, 2019).

* cited by examiner

APPARATUSES AND METHODS FOR CREATING NOISE ENVIRONMENT NOISY DATA AND ELIMINATING NOISE

FIELD OF THE DISCLOSURE

The present application relates to apparatuses and methods for generating noise environment noisy data, and apparatuses and methods for eliminating noise using the same.

BACKGROUND

If ambient noise is mixed in a voice signal, the recognition rate of the voice signal may be significantly lowered. This is mainly due to mismatching with input data at the time of recognition of a voice database for training. In order to overcome this, if a voice signal and noise are mixed, research has been actively conducted for obtaining an original voice signal with the noise removed.

The disclosure of this section is to provide background information relating to the invention. Applicant does not admit that any information contained in this section constitutes prior art.

SUMMARY

Noisy signals such as the sound of people talking boisterously, the sound of a coffee machine, and so on have been artificially added to an original sound to generate a noisy signal, and then the resulting noisy signal has been used to train a noise elimination model based on machine learning and a deep neural network.

However, if a target to remove noise is a voice obtained in a real environment, existing models trained with a noisy signal generated by artificial addition have low performance Nonetheless, acquiring a large amount of data in a real environment to train a noise elimination model is time-consuming and costly, and it may be difficult to obtain various types of noisy signals.

It is an aspect object of the present application to provide apparatuses and methods for generating virtual noise environment noisy data similar to a real environment from an original sound, and apparatuses and methods for eliminating noise capable of training a noise elimination model by utilizing the noise environment noisy data generated therefrom.

In accordance with a first aspect of the present application, there is provided a data generating apparatus for generating noise environment noisy data. The data generating apparatus comprises a signal conversion unit configured to convert each of a noisy signal obtained in real environment and an original sound signal for the noisy signal into a noisy signal spectrum and an original sound signal spectrum in a short-time frequency domain; and a noisy signal generation training unit configured to train deep neural network to output the noisy signal spectrum corresponding to each short-time using the original sound signal spectrum as an input.

It is preferred that, the data generating apparatus further comprises a signal synchronization unit configured to synchronize the noisy signal and the original sound signal for the noisy signal in a time domain.

In accordance with a second aspect of the present application, there is provided a data generating method, performed by a data generating apparatus, for generating noise environment noisy data. The method comprises converting each of a noisy signal obtained in real environment and an original sound signal for the noisy signal into a noisy signal spectrum and an original sound signal spectrum in a short-time frequency domain; and training deep neural network to output the noisy signal spectrum corresponding to each short-time using the original sound signal spectrum as an input.

It is preferred that, the data generating method further comprises synchronizing the noisy signal and the original sound signal for the noisy signal in a time domain.

In accordance with a third aspect of the present application, there is provided a noise eliminating apparatus. The noise eliminating apparatus comprises a signal conversion unit configured to convert each of a first noisy signal obtained in real environment and an original sound signal for the first noisy signal to a first noisy signal spectrum and an original sound signal spectrum and convert a second noisy signal which is input for eliminating a noisy signal to a second noisy signal spectrum of frequency domain; a noisy signal generation training unit configured to train first deep neural network to output the first noisy signal spectrum corresponding to each short-time using the original sound signal spectrum as an input; a spectrum ratio estimation unit configured to train second deep neural network to output a spectrum ratio of the first noisy signal spectrum to the original sound signal spectrum in the each short-time using the first noisy signal spectrum which is output from the first deep neural network; a spectrum calculation unit configured to multiply the spectrum ration of the first noisy signal spectrum to the original sound signal spectrum, output from the second deep neural network, by the second noisy signal spectrum; and a spectrum conversion unit configured to convert a spectrum output by the multiplying into a signal in a time domain.

It is preferred that, the noise eliminating apparatus further comprises a signal synchronization unit configured to synchronize the first noisy signal and the original sound signal for the first noisy signal in the time domain.

In accordance with a forth aspect of the present application, there is provided a noise eliminating method, performed by a noise eliminating apparatus. The noise eliminating method comprises converting each of a first noisy signal obtained in real environment and an original sound signal for the first noisy signal to a first noisy signal spectrum and an original sound signal spectrum; training first deep neural network to output the first noisy signal spectrum corresponding to each short-time using the original sound signal spectrum as an input; training second deep neural network to output a spectrum ratio of the first noisy signal spectrum to the original sound signal spectrum in the each short-time using the first noisy signal spectrum which is output from the first deep neural network; receiving a second noisy signal to remove noise; converting the second noisy signal to a second noisy signal spectrum of frequency domain; multiplying the spectrum ration of the first noisy signal spectrum to the original sound signal spectrum, output from the second deep neural network, by the second noisy signal spectrum; and converting a spectrum output by the multiplying into a signal in a time domain.

In accordance with a fifth aspect of the present application, there is provided a non-transitory computer-readable storage medium including computer executable instructions. The instructions, when executed by a processor, cause the processor to perform converting each of a first noisy signal obtained in real environment and an original sound signal for the first noisy signal into a first noisy signal spectrum and an original sound signal spectrum in a short-time frequency domain; and training first deep neural network to output the first noisy signal spectrum corresponding to each short-time using the original sound signal spectrum as an input.

It is preferred that, the noise eliminating method further comprises synchronizing the first noisy signal and the original sound signal for the first noisy signal in the time domain.

According to the present application, the performance of the noise elimination model can be greatly improved, and it is possible to infinitely expand the database for training the noise elimination model by generating a signal similar to that obtained in a real noise environment and training the noise elimination model through it.

DETAILED DESCRIPTION OF THE PREFERRED EMBODIMENTS

Figure 1:
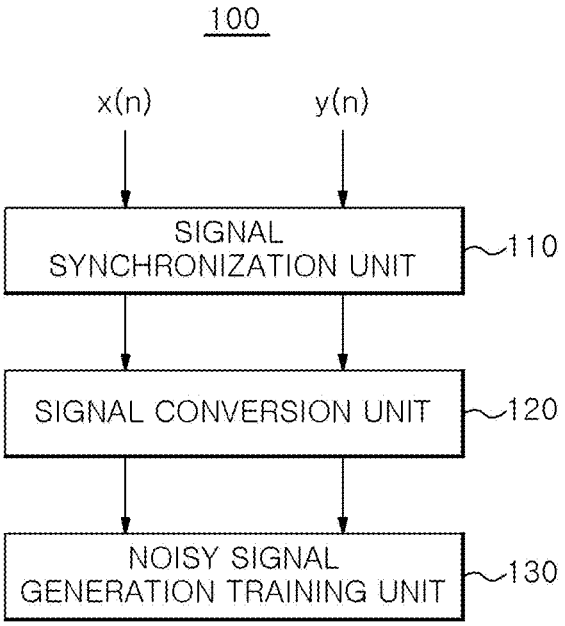
FIG. 1 is a block diagram schematically illustrating a data generating apparatus according to an embodiment of the present application.

First, terms used in the present specification and claims are selected to be generic terms, taking into account the functions in various embodiments of the present application. However, such terms may vary depending on the intentions of those having ordinary skill in the art, legal or technical interpretation, the appearance of new technologies, and so on. In addition, some terms may be arbitrarily selected by the present applicant. These terms may be interpreted by the meaning defined herein, and may be interpreted based on the overall contents of the present specification and common technical knowledge in the art if no specific definition is provided for the terms.

In addition, the same reference numerals or symbols in each of the drawings attached to the present specification denote parts or components that perform substantially the same function. For ease of description and understanding, different embodiments will also be described using the same reference numerals or symbols. That is, even if a plurality of drawings show all the components having the same reference numerals, the plurality of drawings do not mean one embodiment.

Moreover, terms including ordinal numbers such as 'a first', 'a second', etc. may be used to distinguish between components in the present specification and claims. These ordinal numbers are used to distinguish the same or similar components from each other, and the use of such ordinal numbers should not be interpreted to limit the meaning of the terms. As an example, components combined with such ordinal numbers should not be interpreted to limit the order of use, the order of arrangement, or the like by the numbers. If necessary, respective ordinal numbers may be used interchangeably.

As used herein, singular expressions include plural expressions unless the context clearly indicates otherwise. It should be understood that in the present application, terms such as 'comprise' or 'consist of' are intended to indicate the existence of a feature, number, step, operation, component, part, or combinations thereof described in the specification, and not to preclude the possibility of existence or addition of one or more other features, numbers, steps, operations, components, parts, or combinations thereof.

Furthermore, in the embodiments of the present application, when a portion is said to be connected to another portion, this includes not only a direct connection, but also an indirect connection through another medium. In addition, when a portion is said to include a component, it does not mean to exclude other components but may further include other components unless described otherwise.

Hereinafter, the present application will be described in greater detail with reference to the accompanying drawings.

FIG. 1 is a block diagram schematically illustrating a data generating apparatus according to an embodiment of the present application.

The data generating apparatus 100 of the present application includes a signal conversion unit 120 and a noisy signal generation training unit 130.

The signal conversion unit 120 is configured to convert signal data in the time domain into signal data in the frequency domain. For example, the signal conversion unit 120 can use the Short-Time Fourier Transform (STFT) to convert signal data in the time domain into a feature vector in the frequency domain. In this case, the magnitude of a spectrum is primarily used as a feature vector. In the present application, the magnitude of a spectrum is assumed to be an example of a feature vector, and unless otherwise specified, the spectrum refers to an absolute value that is the magnitude of the spectrum.

The noisy signal generation training unit 130 is configured to train a deep neural network to output a noisy signal spectrum corresponding to an original sound signal using an original sound signal spectrum as an input.

Here, the noisy signal spectrum refers to signal data in the frequency domain, acquired by converting at the signal conversion unit 120 a noisy signal (an original sound having noise mixed therein) obtained in a real environment. In addition, the original sound signal spectrum refers to signal data in the frequency domain, acquired by converting at the signal conversion unit 120 the original sound signal with no noise mixed therein compared to the noisy signal.

Meanwhile, the data generating apparatus 100 according to another embodiment of the present application may further include a signal synchronization unit 110.

The signal synchronization unit 110 is configured to synchronize the noisy signal obtained in the real environment and the original sound signal for the noisy signal in the time domain. This is for generating spectrum vectors corresponding to an input and an output in the same signal range when configuring a generation model and a noise elimination model for the noisy signal.

Figure 2:
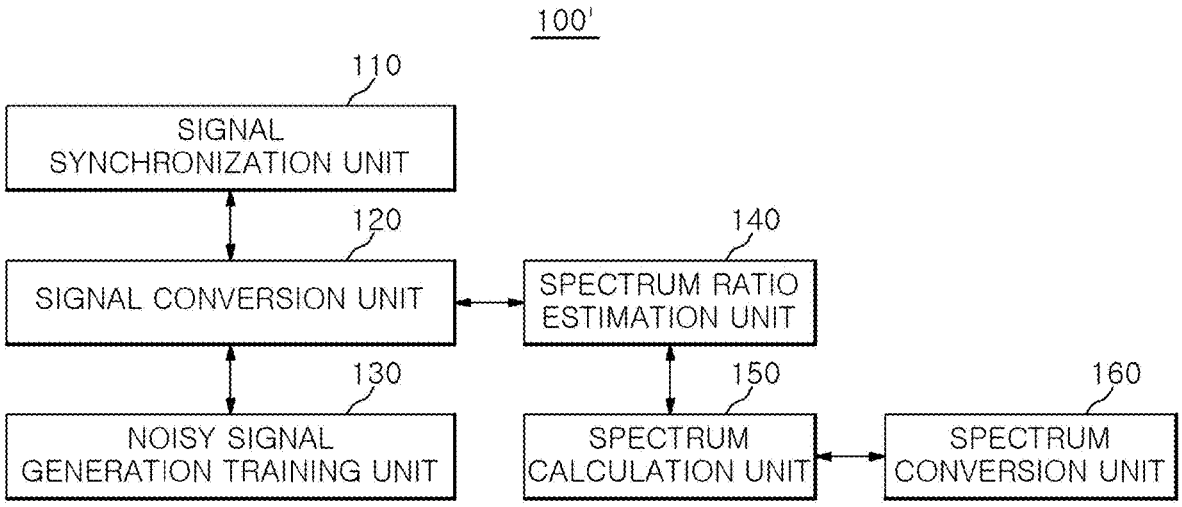
FIG. 2 is a block diagram schematically illustrating a noise eliminating apparatus according to an embodiment of the present application.

FIG. 2 is a block diagram schematically illustrating a noise eliminating apparatus according to an embodiment of the present application.

As shown in FIG. 2, the noise eliminating apparatus 100' according to another embodiment of the present application may further include a noisy signal generation training unit 130, a spectrum ratio estimation unit 140, a spectrum calculation unit 150, and a spectrum conversion unit 160, in the data generating apparatus 100.

The noisy signal generation training unit 130 is configured to output a short-time spectrum of a noisy signal obtained in a real environment using spectra corresponding to each short-time converted through the signal conversion unit 120 as training data, when a short-time spectrum of an original sound signal is input.

The spectrum ratio estimation unit 140 is configured to train a deep neural network to output a ratio of the short-time spectrum of the noisy signal to the short-time spectrum of the original sound signal (Ideal Ratio Mask, IRM) using a noisy signal spectrum output from the noisy signal generation training unit 130 as an input.

The spectrum calculation unit 150 is configured to multiply the ratio of spectra output from the spectrum ratio estimation unit 140 by the spectrum of a second noisy signal which is newly input for eliminating noise.

The spectrum conversion unit 160 is configured to convert signal data in the frequency domain into signal data in the time domain. For example, the spectrum conversion unit 160 can use the Inverse Short-Time Fourier Transform (ISTFT) to convert a feature vector in the frequency domain into signal data in the time domain.

Figure 3:
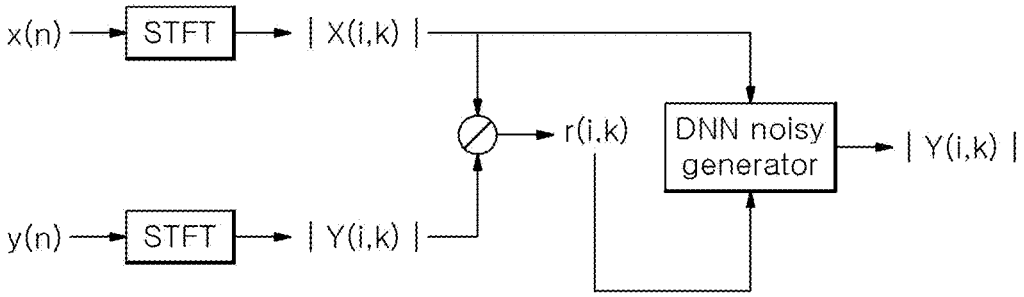
FIG. 3 is a block diagram for briefly describing a deep neural network training process for generating data according to an embodiment of the present application.

FIG. 3 schematically illustrates a deep neural network training process for generating data according to an embodiment of the present application, and is for describing a data training process of the signal synchronization unit 110, the signal conversion unit 120 configured to convert a noisy signal y(n) obtained in a real environment into the frequency domain and to generate a noisy signal spectrum for each short-time, and the noisy signal generation training unit 130 that is the part for training the deep neural network to output the noisy signal spectrum generated above for an original sound x(n) as described above.

With the signal conversion unit 120, the Short-Time Fourier Transform is performed on the noisy signal y(n) obtained in the real noise environment and the original sound x(n) for the corresponding sound to result in Y(i, k) and X(i, k).

As shown in FIG. 3, the noisy signal generation training unit 130 may train the ratio r(i, k) of two spectra as in Eqn. 1 below on a frame basis so as to configure a noisy signal generation model for generating a noisy signal from an original sound signal.

[Equation 1]

$$r(i,k) = \frac{|Y(i,k)|}{|X(i,k)|} \tag{1}$$

In the equation above, i and k denote a frame index and a frequency bin index, respectively, and the virtual noisy signal spectrum, $|\hat{Y}(i,k)|$, generated at the noisy signal generation training unit 130 is generated through Eqn. 2 below:

[Equation 2]

$$|\hat{Y}(i,k)| = \hat{r}(i,k)|X(i,k)| \tag{2}$$

In the equation above, |X(i, k)| is the spectrum of the original sound signal from which a noisy signal is to be generated, and $\hat{r}(i,k)$ is the ratio of spectra trained at the noisy signal generation training unit 130.

As described above, by training the spectrum ratio of the noisy signal obtained in the real environment and the original sound signal corresponding thereto, it is possible to infinitely generate virtual noisy signals for original sound signals that are newly input, and to train a noise elimination model through the virtual noisy signals generated.

Here, the noise elimination model may be implemented using a deep neural network of the same structure as the noisy signal generationmodel.

Specifically, the noise elimination model for eliminating noise from noisy signals may be trained as a model having $|\hat{Y}(i,k)|$ as input and $|X(i,k)|/|\hat{Y}(i,k)|$ as output in a deep neural network of the same structure in the number of nodes, the number of hidden layers, the active function, and so on as the noisy signal generationmodel illustrated in FIG. 3.

Figure 4:
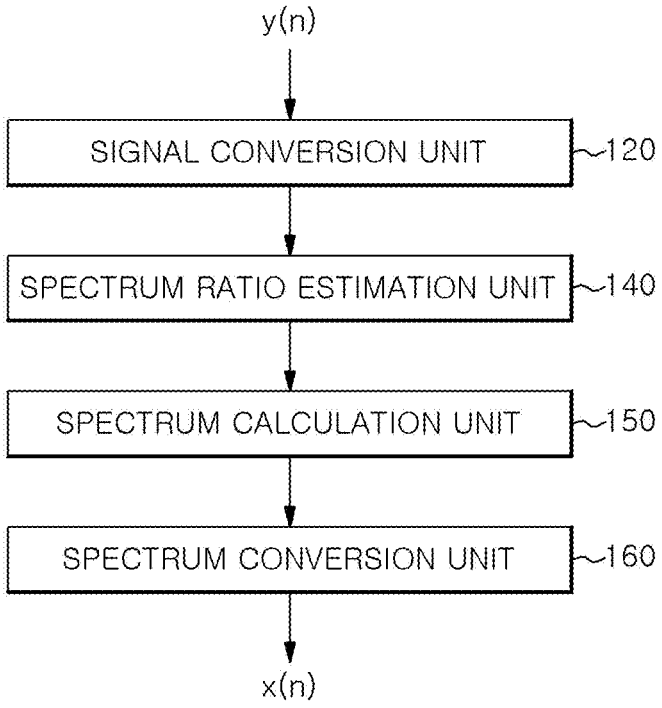
FIG. 4 is a block diagram for briefly describing a configuration for eliminating noise of the noise eliminating apparatus according to an embodiment of the present application.

FIG. 4 is a block diagram for briefly describing a configuration for eliminating noise of the noise eliminating apparatus according to an embodiment of the present application.

In the noise eliminating apparatus 100', when a noisy signal y(n) for eliminating noise is input to the signal conversion unit 120, the signal conversion unit 120 converts the noisy signal y(n) into a spectrum |Y(i, k)| in the frequency domain.

The spectrum ratio estimation unit 140 outputs the spectrum ratio (the ratio of the noisy signal spectrum to be trained to the original sound signal spectrum to be trained) output according to the trained deep neural network, and the spectrum ratio estimation unit 140 performs an operation of multiplying the output spectrum ratio by the noisy signal spectrum |Y(i, k)|.

The multiplication operation yields the spectrum of the original sound signal |X(i, k)| with respect to the spectrum of the noisy signal |Y(i, k)|, and the spectrum conversion unit 150 converts the calculated |X(i, k)| into a signal in the time domain, so as to output the original sound signal x(n) acquired by removing noise from the input noisy signal y(n).

Although both the training of the noisy signal generation model described in relation to FIG. 3 and the training of the noise elimination model described in relation to FIG. 4 may be performed in one noise eliminating apparatus 100', the training of the noisy signal generation model and that of the noise elimination model may also be implemented in different apparatuses depending on embodiments.

In other words, only the signal conversion unit 120, the spectrum ratio estimation unit 140, the spectrum calculation unit 150, and the spectrum conversion unit 160 may be included in a signal processing apparatus for training the noise elimination model, and the signal synchronization unit 110, the signal conversion unit 120, and the noisy signal generation training unit 130 may be included in the data generating apparatus 100 for training the noisy signal generation model as illustrated in FIG. 1.

Figure 5:
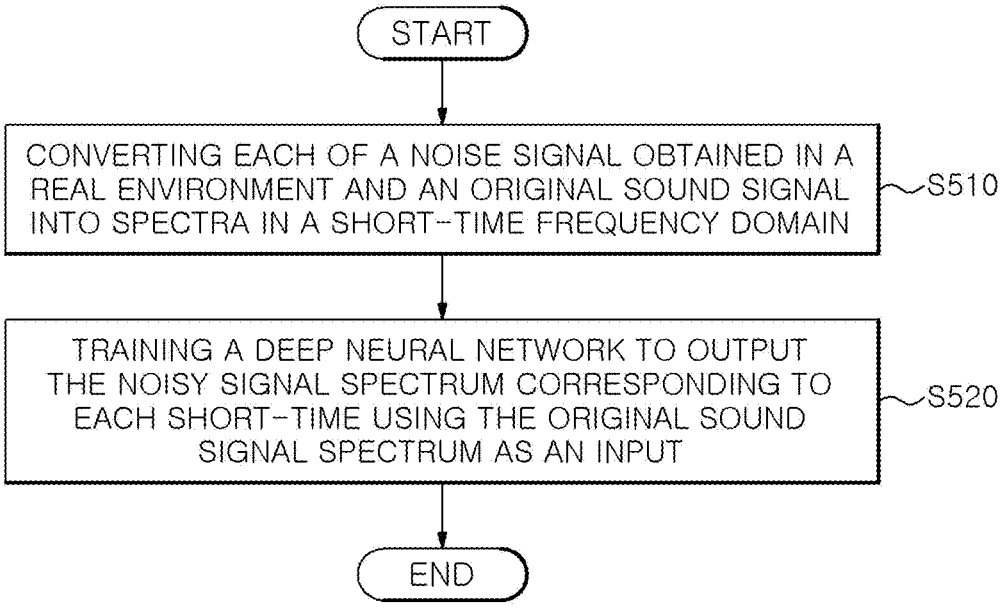
FIG. 5 is a flowchart for briefly describing a data generating method according to an embodiment of the present application.

FIG. 5 is a flowchart for briefly describing a data generating method according to an embodiment of the present application.

First, each of a noisy signal obtained in a real environment and an original sound signal for the noisy signal is converted into a noisy signal spectrum and an original sound signal spectrum in a short-time frequency domain in S510. At this time, the noisy signal obtained in the real environment and the original sound signal for the noisy signal may be synchronized in the time domain.

Next, a deep neural network is trained to output the noisy signal spectrum corresponding to each short-time using the original sound signal spectrum as an input in S520.

Figure 6:
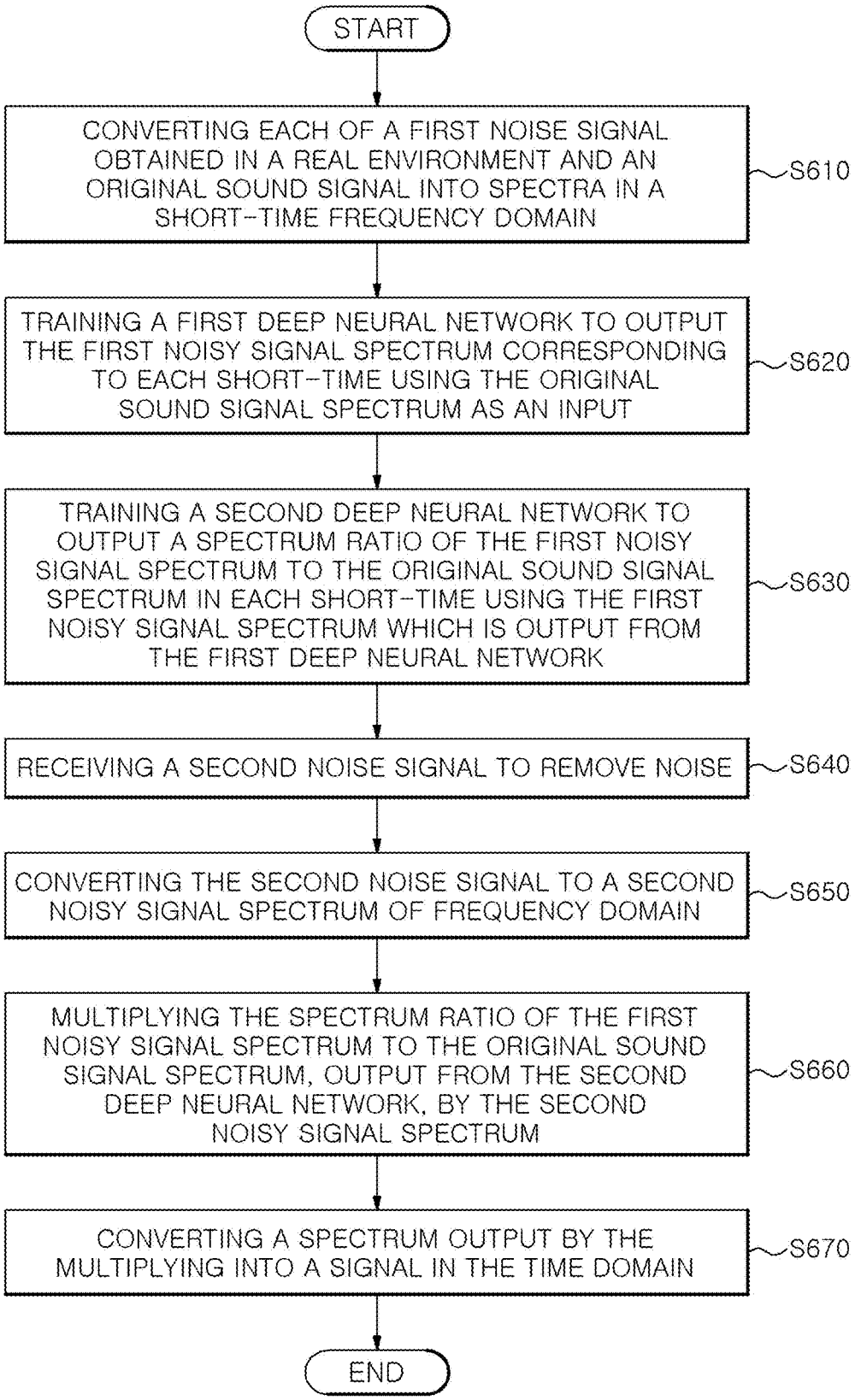
FIG. 6 is a flowchart for briefly describing a noise eliminating method according to an embodiment of the present application.

FIG. 6 is a flowchart for briefly describing a noise eliminating method according to an embodiment of the present application.

First, each of a first noisy signal obtained in a real environment and an original sound signal for the first noisy signal is converted into a first noisy signal spectrum and an original sound signal spectrum in S610. At this time, the first noisy signal obtained in the real environment and the original sound signal for the first noisy signal may be synchronized in the time domain.

Next, a first deep neural network is trained to output the first noisy signal spectrum corresponding to each short-time using the original sound signal spectrum as an input in S620.

Next, a second deep neural network is trained to output a spectrum ratio of the first noisy signal spectrum to the original sound signal spectrum in each short-time using the first noisy signal spectrum which is output from the first deep neural network as an input in S630.

Next, a second noisy signal to remove noise is received in S640.

Next, the second noisy signal that has been received is converted into a second noisy signal spectrum of the frequency domain in S650.

Next, the spectrum ratio of the first noisy signal spectrum to the original sound signal spectrum, output from the second deep neural network, is multiplied by the second noisy signal spectrum in S660.

Next, a spectrum output by the multiplying is converted into a signal in the time domain in S670.

As described above, when a model is constructed based on actually acquired noisy signals, noise elimination training is possible more effectively than when a model is constructed with noisy signals having noise added thereto artificially.

According to the various embodiments of the present application as described above, by constructing virtual mixed signal data similar to a real environment from an original sound and training a noise elimination model, it is possible to greatly improve the performance of a noise elimination model based on deep learning.

The control method according to the various embodiments described above may be implemented as a program and stored in various recording media. In other words, a computer program processed by various processors and capable of executing the noise eliminating method described above may also be used in a state of being stored in a recording medium.

As an example, there may be provided a non-transitory computer readable medium having stored thereon a program for performing i) a step of converting each of a noisy signal obtained in a real environment and an original sound signal for the noisy signal into a first noisy signal spectrum and an original sound signal spectrum in a short-time frequency domain, ii) a step of training a deep neural network to output the noisy signal spectrum corresponding to each short-time using the original sound signal spectrum as an input.

The non-transitory readable medium refers to a medium that stores data semi-permanently and that can be read by a device, rather than a medium that stores data for a short moment, such as a register, a cache, a memory, and so on. Specifically, the various applications or programs described above may be stored and provided in a non-transitory readable medium such as a CD, a DVD, a hard disk, a Blu-ray disk, a USB, a memory card, a ROM, and the like.

What is claimed is:

1. A data generating apparatus for generating noise environment noisy data, the data generating apparatus comprising:

a signal conversion unit configured to convert each of a first noisy signal obtained in real environment and an original sound signal for the first noisy signal into a first noisy signal spectrum and an original sound signal spectrum in a short-time frequency domain, and convert a second noisy signal which is input for eliminating a noisy signal to a second noisy signal spectrum of frequency domain;

a noisy signal generation training unit configured to train a first deep neural network to output the first noisy signal spectrum corresponding to each short-time using the original sound signal spectrum as an input;

a spectrum ratio estimation unit configured to train second deep neural network to output a spectrum ratio of the first noisy signal spectrum to the original sound signal spectrum in the each short-time using the first noisy signal spectrum which is output from the first deep neural network; and a spectrum calculation unit configured to multiply the spectrum ratio of the first noisy signal spectrum to the original sound signal spectrum, the spectrum ratio being output from the second deep neural network, by the second noisy signal spectrum.

2. The data generating apparatus of claim 1, the data generating apparatus further comprising:

a spectrum conversion unit configured to convert a spectrum output by the multiplying into a signal in a time domain.

3. The data generating apparatus of claim 1, further comprising:

a signal synchronization unit configured to synchronize the first noisy signal and the original sound signal for the first noisy signal in a time domain.

4. A data generating method, performed by a data generating apparatus, for generating noise environment noisy data, the method comprising:

converting each of a first noisy signal obtained in real environment and an original sound signal for the first noisy signal into a first noisy signal spectrum and an original sound signal spectrum in a short-time frequency domain;

training a first deep neural network to output the first noisy signal spectrum corresponding to each short-time using the original sound signal spectrum as an input;

receiving a second noisy signal to remove noise;

converting the second noisy signal to a second noisy signal spectrum of frequency domain;

training a second deep neural network to output a spectrum ratio of the first noisy signal spectrum to the original sound signal spectrum in the each short-time using the first noisy signal spectrum which is output from the first deep neural network; and multiplying the spectrum ratio of the first noisy signal spectrum to the original sound signal spectrum, output from the second deep neural network, by the second noisy signal spectrum.

5. The data generating method of claim 4, further comprising:

converting a spectrum output by the multiplying into a signal in a time domain.

6. The data generating method of claim 4, further comprising:

synchronizing the first noisy signal and the original sound signal for the first noisy signal in the time domain.

7. A non-transitory computer-readable storage medium including computer executable instructions, wherein the instructions, when executed by a processor, cause the processor to perform:

converting each of a first noisy signal obtained in real environment and an original sound signal for the first noisy signal into a first noisy signal spectrum and an original sound signal spectrum in a short-time frequency domain;

training a first deep neural network to output the first noisy signal spectrum corresponding to each short-time using the original sound signal spectrum as an input;

receiving a second noisy signal to remove noise;

converting the second noisy signal to a second noisy signal spectrum of frequency domain;

training a second deep neural network to output a spectrum ratio of the first noisy signal spectrum to the original sound signal spectrum in the each short-time using the first noisy signal spectrum which is output from the first deep neural network; and multiplying the spectrum ratio of the first noisy signal spectrum to the original sound signal spectrum, the spectrum ratio being output from the second deep neural network, by the second noisy signal spectrum.

* * * * *